United States Patent [19]

Kolodzie et al.

[11] Patent Number: 4,955,183

[45] Date of Patent: Sep. 11, 1990

[54] BURNER FOR DIFFICULT TO COMBUST GAS MIXTURES

[75] Inventors: Rainer Kolodzie, Munich; Dieter Goerlich, Emmering; Roland Fiola, Graefelfing, all of Fed. Rep. of Germany

[73] Assignee: Webasto AG Fahrzeugtechnik, Fed. Rep. of Germany

[21] Appl. No.: 310,588

[22] Filed: Feb. 15, 1989

[30] Foreign Application Priority Data

Mar. 9, 1988 [DE] Fed. Rep. of Germany .... 3807632.2
Aug. 19, 1988 [DE] Fed. Rep. of Germany ..... 3828256

[51] Int. Cl.[5] ..... F01N 3/26
[52] U.S. Cl. ..... 60/303; 422/182
[58] Field of Search ..... 60/303; 431/263; 422/182

[56] References Cited

U.S. PATENT DOCUMENTS

| | | | |
|---|---|---|---|
| 3,385,527 | 5/1968 | Drewry | 431/263 |
| 3,850,581 | 11/1974 | Hills et al. . | |
| 4,506,506 | 3/1985 | Usui | 60/303 |
| 4,571,938 | 2/1986 | Sakurai . | |
| 4,604,868 | 8/1986 | Nomoto | 60/303 |
| 4,622,811 | 11/1986 | Distel | 60/303 |
| 4,651,524 | 3/1987 | Brighton | 60/303 |

FOREIGN PATENT DOCUMENTS

| | | | |
|---|---|---|---|
| 3526074 | 1/1987 | Fed. Rep. of Germany . | |
| 1033119 | 7/1953 | France . | |
| 2163952 | 7/1973 | France . | |
| 2244081 | 4/1975 | France . | |
| 59-29718 | 2/1984 | Japan | 60/303 |

*Primary Examiner*—Douglas Hart

[57] ABSTRACT

A burner for difficult to combust gas mixtures, particularly those including exhaust gases of an internal combustion engine, that is preferably intended for the regeneration of particle filter units in the exhaust gas duct of an internal combustion engine, such as a diesel internal combustion engine. For initiating the regeneration of such so-called soot filter units, the burner generates hot combustion gases at the outlet thereof. The burner includes, at a distance from the discharge opening of a fuel injection nozzle, a baffle barrier that extends approximately perpendicular to the center axis of the fuel injection nozzle. This baffle barrier divides the combustion chamber into an energy-rich zone with a gas mixture prepared to be ignitable and a second zone in which the exhaust gas from the internal combustion engine is diverted. In this way, the burner can also burn even difficult to combust gas mixtures and can reliably maintain, regardless of the operation conditions of the internal combustion engine, a flame in the combustion chamber for generating hot combustion gases.

11 Claims, 2 Drawing Sheets

BURNER FOR DIFFICULT TO COMBUST GAS MIXTURES

BACKGROUND OF THE INVENTION

The invention relates to a burner for difficult to combust gas mixtures, particularly for exhaust gases of an internal combustion engine, wherein the burner has a combustion chamber, an ignition device and a fuel injection nozzle.

As used in connection with the present invention, the term difficult to combust gas mixtures refers to those that either contain little oxygen or include fuels that are difficult to burn, i.e. are relatively incombustible in comparison to typical fuels, such as fuel oils, kerosene and gasoline. In a principle application of such a burner, the burner is used to generate hot combustion gases that are used, for example, to initiate the regeneration of a particle filter unit in an exhaust gas duct of a diesel engine by burning off accumulated soot particles and the like in the filter unit.

In an older commonly assigned application U.S. patient application Ser. No. 235,292 filed Aug. 23, 1988), an exhaust gas burner is described, wherein an auxiliary burner for the ignition of such gas mixtures is provided which is supplied with compressed air. According to another embodiment described therein, the burner is provided with an auxiliary air injection device at the level of the fuel nozzle within the burner. These features are provided, in particular for the regeneration of an exhaust gas filter unit, so that the regeneration of the filter unit can be performed regardless of the oxygen content in the exhaust gas. In the area around the ignition device, an extremely combustible mixture is prepared so as to cause an ignition of the burner even when the oxygen content of the exhaust gas is low. As known, the oxygen content of the exhaust gas is subjected to wide fluctuations, that depend especially on the instantaneous operating level in the engine family of characteristics of diesel internal combustion engines in motor vehicles. This residual oxygen content in the exhaust gas can be between about 20% and about 4%.

In German Offenlegungsschrift No. 35 26 074, a device for removing combustible solid particles from exhaust gases of internal combustion engines is described in which a pilot burner is connected by an overflow opening to a combustion chamber, Wherein additional air and fuel are fed to the pilot burner. A partial exhaust gas stream enriched with the solid particles is introduced into the combustion chamber by a first spray nozzle tube, after which, the solid particles are burned off together with the additional air brought into the combustion chamber. Then, the stream is again carried away together with the remaining combustion products by a second spray nozzle tube as purified exhaust gas. By this device, the combustible solid particles within exhaust gas are burned in the combustion chamber directly for the purpose of exhaust gas purification. There is no description or indication of the use of this device in connection with the regeneration of soot filter units, whereas this device represents an alternative to the use of particle filter units in the exhaust gas area of a diesel engine.

SUMMARY OF THE INVENTION

The primary object of the invention is, thus, to provide a burner for difficult to combust gas mixtures that can be reliably ignited even when the gas mixtures have an extreme lack of oxygen or a limited $O_2$ content in the exhaust gas, wherein the flame can be stably maintained in the burner.

According to the invention, a burner for difficult to combust gas mixtures, particularly for exhaust gases of a diesel engine, that includes a combustion chamber, an ignition device and a fuel injection nozzle, is provided with a baffle barrier at a distance, measured in the nozzle jet direction of the fuel injection nozzle from its discharge opening, wherein the baffle barrier extends approximately perpendicularly to the center axis of the fuel injection nozzle.

In the burner according to the invention, the baffle barrier divides the combustion chamber in the axial direction thereof so that an area is provided between the baffle barrier and the discharge opening of the fuel injection nozzle in which an oxygen-enriched zone forms, that is energy-rich and has a high heat flow density. In this zone, a stable pilot flame can be generated and maintained, whereby the difficult to combust gas mixture can be ignited. In the design according to the invention, part of the fuel delivered from the fuel injection nozzle directly impinges on the baffle barrier, wherein the baffle barrier is located in an area of the combustion chamber such that it becomes red hot.

The temperature increase associated with a red hot baffle barrier has been found to increase the combustibility of the mixture. A flame-out situation or extinguishment of the flame in the combustion chamber is thereby prevented, even if the exhaust gases fed into the combustion chamber have a low oxygen content and/or if large quantities of exhaust gas with high flow rates are fed therein. Thus, the burner with a baffle barrier according to the present invention guarantees that the flame in the combustion chamber is stably maintained regardless of the quantity of and the oxygen content of the exhaust gas. The baffle barrier further causes the generation of a turbulence downstream from it, whereby mixing of the gases with the fuel is intensified in the combustion chamber downstream from the baffle barrier. In this way, overall more favorable combustion conditions are achieved in the combustion chamber.

Since, according to a preferred embodiment of the present invention, only a part of the fuel exiting the fuel nozzle impinges the baffle barrier, while the rest of the fuel passes it by, fuel is also present in the area of the combustion chamber downstream from the baffle barrier. This fuel then mixes with the downstream gases into a combustible gas mixture, so that the pilot flame generated in the zone between the fuel nozzle and the baffle barrier can easily extend into the area downstream from the baffle barrier for combustion of the gas mixture present therein.

Preferably, the baffle barrier is designed as a baffle plate that is suitably placed coaxially to the axis of the fuel nozzle so that a circular space is defined between the wall of the combustion chamber and the outer side edge of the baffle plate, through which fuel delivered from the fuel nozzle can reach the area of the combustion chamber downstream from the baffle plate.

According to an alternative embodiment, the baffle barrier is made of a perforated plate having a center opening, wherein the perforated plate is attached to the wall of the combustion chamber. In this case, the fuel from the fuel injection nozzle can pass through the center opening of the perforated plate into the area of the combustion Chamber downstream from the perforated plate.

According to another embodiment of the present invention, the baffle barrier can be formed by a reduced-diameter area of the combustion chamber, such as e.g., a constriction, so that no additional parts, such as a baffle plate or a perforated plate, need be provided in the combustion chamber.

Another preferred modification of the burner according to the present invention includes the provision of combustion air, i.e., fresh air or additional air, introduced into at least the area between the baffle barrier and the fuel injection nozzle with the exhaust gas from the diesel engine, so that in the ignition phase of the burner, a pilot flame can be quickly and reliably generated in the area between the fuel nozzle and the baffle barrier.

According to a further feature of the present invention, the exhaust gas of a diesel engine is introduced into the combustion chamber of the burner at a point near the end of the combustion chamber away from the fuel injection nozzle. In this way, the exhaust gas does not directly reach the area between the fuel injection nozzle and the baffle barrier, so that the preparation of an extremely combustible gas mixture in this area is not negatively influenced, due to the presence of exhaust gases of the internal combustion engine.

Surprisingly, it has also been found that the operation of the burner can be improved if the baffle barrier is designed for example as a cone, sphere, or circular shell that approximates a cone.

These and further objects, features and advantages of the present invention will become more obvious from the following description when taken in conjunction with the accompanying drawings which show, for the purposes of illustration only, several embodiments in accordance with the present invention.

DETAILED DESCRIPTION OF THE PREFERRED EMBODIMENTS

Figure 1:
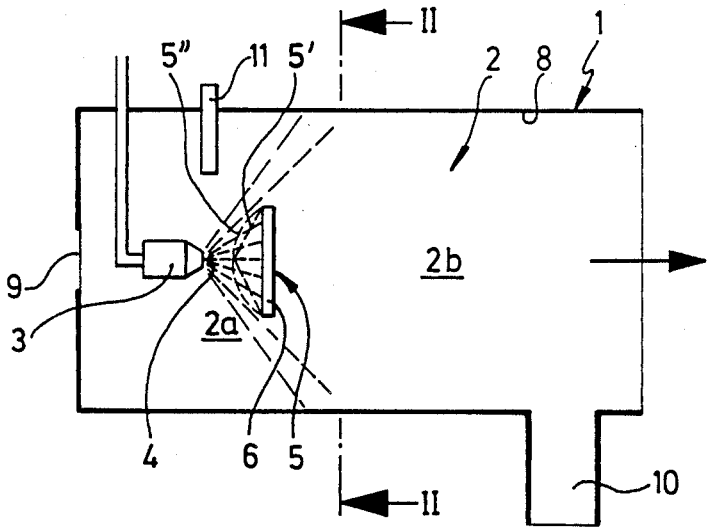
FIG. 1, is a diagrammatic sectional view of a burner with a baffle barrier.

In each of the several figures, the same or similar parts are designated by the same reference numerals.

In FIG. 1, a burner is identified overall by reference numeral 1. Burner 1 includes a combustion chamber 2, provided on one end thereof with a fuel injection nozzle 3 for fuel feed. An arrow indicates the direction of travel of a hot combustion gas stream, which exits combustion chamber 2 at the end of combustion chamber 2 opposite the fuel injection nozzle 3, and which, in the preferred embodiment of the invention, is fed to a particle filter unit (not represented) in the exhaust gas duct of a diesel internal combustion engine. Therefore, the particle filter(s), such as soot filters, can be regenerated after the accumulation of soot particles by burning off the soot particles in the soot filter, which can be initiated by the hot combustion gases exiting combustion chamber 2.

The fuel nozzle jet stream delivered from discharge opening 4 of the fuel injection nozzle 3 is shown in dashed lines. As seen in the direction of this fuel nozzle jet stream, at a distance from discharge opening 4 of fuel injection nozzle 3, there is placed a baffle barrier, designated overall by reference numeral 5. Baffle barrier 5 is made, in the embodiment according to FIGS. 1 and 2, of a baffle plate 6, which is attached to wall 8 of combustion chamber 2 by flanges 7. The baffle barrier 5 divides combustion chamber 2 into a first zone 2*a*, located between fuel injection nozzle 3 and baffle barrier 5, and a second zone 2*b*, located downstream from baffle barrier 5.

Through the opening, indicated diagrammatically by 9, preferably oxygen-rich air, such as e.g., fresh air or additional air, enters combustion chamber 2. On the end of combustion chamber 2 away from fuel injection nozzle 3, an inlet 10 is provided, whereby the exhaust gases, for example, from the internal combustion engine, are introduced into the combustion chamber 2. Further, an ignition device 11 is provided extending into the combustion chamber 2 adjacent the fuel injection nozzle 3, as shown in FIG. 1.

The operation of burner 1, as detailed above, is described in detail below. In the first zone 2*a* of burner 1, around fuel injection nozzle 3, optionally with the feeding of additional air by opening 9, an extremely combustible mixture of fuel and combustion air is prepared, wherein a part of the fuel delivered by the fuel injection nozzle 3 impinges on baffle barrier 5. With the aid of ignition device 11, the combustible mixture thus prepared in first zone 2*a* of combustion chamber 2 is ignited, and a pilot flame is formed in the first zone 2*a*. By this pilot flame, the baffle barrier 5, designed according to FIGS. 1 and 2 as baffle plate 6, is heated, and in doing so, vaporization of the portion of the fuel jet that impinges baffle barrier 5 is intensified by the increased temperature of the baffle barrier 5, caused by the pilot flame heating baffle barrier 5. Moreover, the ambient temperature in combustion chamber 2 is increased. The fuel vapor thus produced is carried over with the part of the fuel that goes past baffle barrier 5 into the second zone 2*b* of the combustion chamber 2, so that then, with the aid of the pilot flame in first zone 2*a*, the gas mixture in second zone 2*b* of the combustion chamber can be made to reliably combust with the aid of the energy released therein. This gas mixture in the second zone 2*b* of combustion chamber 2 contains, as a main fuel, the exhaust gases of the internal combustion engine introduced by inlet 10, whose oxygen content, quantity and flow rate can fluctuate greatly depending on the operating conditions of the internal combustion engine. The baffle barrier 5 also, simultaneously, supports the intermixture of fuel and gas in zone 2*b* of combustion chamber 2, by way of a turbulence created in the gas mixture that is generated by the baffle barrier 5.

During the combustion operation of burner 1, the baffle barrier 5 becomes red hot, and the heat emanating from the red hot baffle barrier 5 increases the flame backflash rate in the area of the flame root due to the position of baffle barrier 5. Therefore, a stable flame is maintained in combustion chamber 2. Even if exhaust gas with a low oxygen content and/or if large exhaust gas quantities enter by the inlet 10, and/or if the exhaust gas enters with a high flow rate, a stable flame is maintained due to the design as above. Thus, a flame-out situation in the combustion chamber 2 and an extinguishment of the flame are effectively prevented. With the burner according to the invention, at the start of the burner operation, a kind of pilot flame can thus be reliably generated in first zone 2*a* of combustion chamber 2 with the support of baffle barrier 5, so that even with extremely unfavorable conditions, the difficult to combust gas mixture in second zone 2*b* of combustion chamber 2 can be ignited. Summarily, during the burner operation of burner 1, as assisted by the baffle barrier 5, a stable flame is maintained in combustion chamber 2 even under unfavorable combustion conditions in second zone 2*b* of combustion chamber 2.

Figure 2:
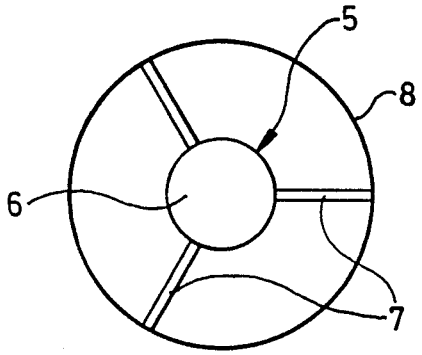
FIG. 2, is a top view of the burner according to FIG. 1 in the sectional plane II—II in FIG. 1.

The modified embodiments of burner 1, explained below coincide operatively and functionally with the FIGS. 1 and 2 embodiment, so that only the structural differences of the modified burners relative to the burner 1 embodiment of FIGS. 1 and 2 are described in more detail below.

Figure 3:
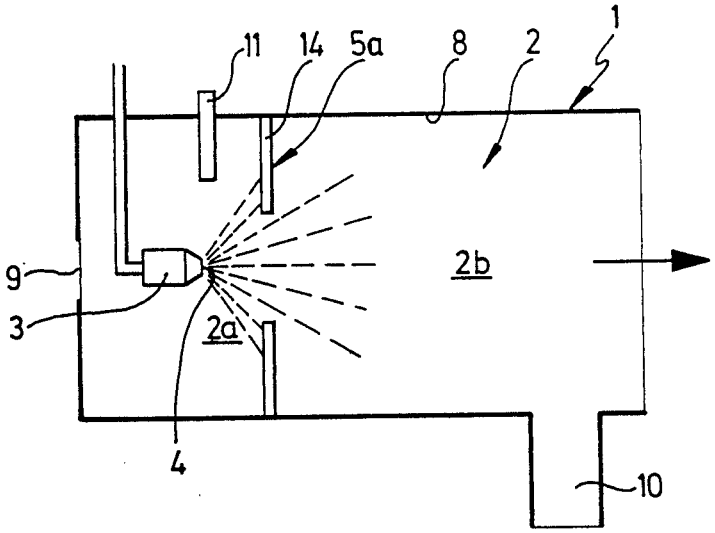
FIG. 3, is a diagrammatic view of a modified embodiment of a burner with a second baffle barrier design.

The burner 1 according to FIG. 3 provides, as a baffle barrier 5*a*, a perforated plate 14, which is attached to wall 8 of combustion chamber 2 at a distance from fuel injection nozzle 3. The perforated plate 14 has at least one center opening 15 located approximately at an axial extension line of discharge opening 4 of fuel injection nozzle 3, through which the fuel from fuel injection nozzle 3 can reach second zone 2*b* of combustion chamber 2. The other part of the fuel delivered by fuel injection nozzle 3 impinges the plate-shaped part of perforated plate 14, so that baffle barrier 5*a* in the form of perforated plate 14 leads to essentially the same effects as baffle barrier 5 in the form of baffle plate 6 according to FIGS. 1 and 2.

Figure 4:
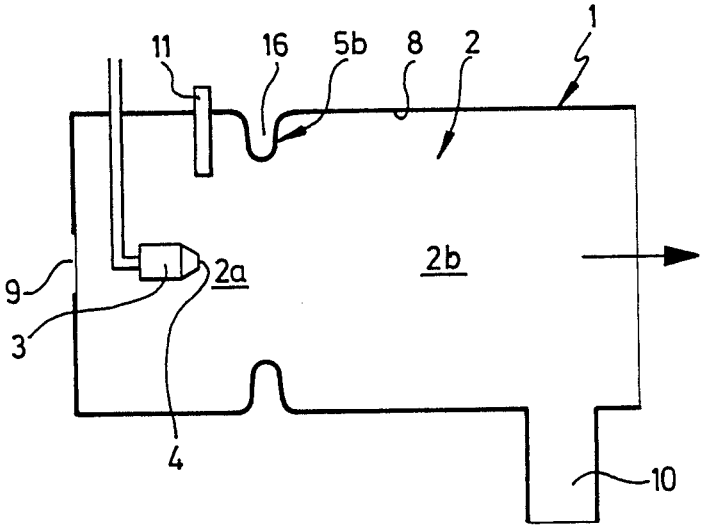
FIG. 4, is another modified embodiment of a burner with another baffle barrier design.

In FIG. 4, a burner 1 is illustrated with a baffle barrier 5*b* that is provided in a manner which reduces the free aperture cross section of combustion chamber 2. As represented in FIG. 4, baffle barrier 5*b* is made in the form of a constriction of the wall 8 which defines the periphery of the combustion chamber 2. With this baffle barrier 5*b* in the form of a Constriction 16, essentially the same effects are achieved as those in connection with the embodiments according to FIGS. 1, 2 and 3, a portion of the fuel passing through the constriction into second zone 2*b* and a portion impinging upon the constriction to form a pilot flame in zone 2*a*.

Of course the invention is not intended to be limited to the present examples, whereas numerous alterations and modifications are possible that would be obvious to one of ordinary skill in the art without leaving the concept of the present invention. In particular, combinations of the embodiments explained above of the baffle barriers 5, 5*a* and 5*b* can also be made or, for example, two or more baffle barriers 5, 5*a*, 5*b* can be arranged at a distance from one another, one behind the other, viewed in the fuel flow direction. Of course the effect of baffle barriers 5, 5*a*, 5*b* can also be achieved by a suitable design of the inner wall 8 of the combustion chamber 2 and/or with a suitable arrangement of the fuel injection nozzle 3. Further, it is possible that the fuel injection nozzle 3 can be arranged axially offset or slanted, instead of coaxially provided in the combustion chamber 2 as illustrated in the figures.

Also, as shown in FIG. 1 in dashed lines, baffle plate 6 can be replaced by a baffle cone 5′ or a circular shell baffle barrier 5″. As the baffle barrier 5, one with a spherical shape could also be selected. In this way, with simplification from a manufacturing engineering viewpoint, a more efficient operation of the burner 1 can advantageously be achieved.

Therefore, since other and further modifications and embodiments will be apparent to those of ordinary skill, the invention should not be viewed as limited to those features and embodiments described above, but rather encompasses the full scope of the claims setforth hereafter.

What is claimed is:

1. Burner for difficult to combust gas mixtures, such as exhaust gases of an internal combustion engine, comprising a combustion chamber, a baffle barrier dividing said combustion chamber into a first, pilot flame zone and a second, main fuel combustion zone at opposite sides thereof, means for supplying fuel and combustion air to said pilot flame zone, means for supplying exhaust gases to said fuel combustion zone, and ignition means in said pilot flame zone for creating a pilot flame thereat; wherein said fuel supply is provided by a fuel injection nozzle in the form of a fuel jet; wherein said baffle barrier is disposed in a position causing a first portion of the fuel jet supplied to the pilot flame zone to impinge thereon, and a second portion of said fuel jet to pass through the baffle barrier into the main fuel combustion zone; and wherein the pilot flame created by said ignition means forms a means for igniting said second portion of the fuel jet in said main combustion zone utilizing the exhaust gases supplied thereto as an oxygen supply for combustion thereof.

2. Burner according to claim 1, wherein said baffle barrier comprises a baffle plate.

3. Burner according to claim 1, wherein said baffle barrier is comprised of a perforated plate provided with at least one center opening and which is attached to a wall of the combustion chamber.

4. Burner according to claim 1, wherein said baffle barrier forms a reduced-diameter area by a wall of said combustion chamber said wall extending into said combustion chamber.

5. Burner according to claim 4, wherein the wall of the reduced-diameter area is a constriction of a circumferential wall of said combustion chamber.

6. Burner according to claim 1, wherein said means for supplying combustion air comprises an opening through a wall of said combustion chamber near said fuel injection nozzle, and said combustion air is oxygen-rich fresh air or additional air.

7. Burner according to claim 1, wherein said means for supplying exhaust gases comprises an exhaust gas inlet means, in an area of said combustion chamber other than an area defined between said baffle barrier and said fuel injection nozzle, for operation of the burner with exhaust gas from an internal combustion engine.

8. Burner according to claim 7, wherein said exhaust gas inlet means is constructed in a manner for connection to an exhaust pipe from the internal combustion engine and is provided on a wall of said combustion chamber near a hot gas stream exit of said combustion chamber.

9. Burner according to claim 1, wherein said baffle barrier; is peripherally bounded by a circularly contoured surface.

10. Burner according to claim 7, wherein the baffle barrier is in the shape of a baffle cone.

11. Burner according to claim 7, wherein the baffle barrier is in the form of a partially spherical shell.

* * * * *